US010475382B2

(12) United States Patent
Chung et al.

(10) Patent No.: US 10,475,382 B2
(45) Date of Patent: Nov. 12, 2019

(54) DISPLAY DEVICE HAVING COMPENSATION FOR DEGRADATION OF DRIVING TRANSISTORS AND ELECTRONIC DEVICE HAVING THE SAME

(71) Applicant: Samsung Display Co., Ltd., Yongin-Si, Gyeonggi-Do (KR)

(72) Inventors: Bo-Yong Chung, Suwon-si (KR); Dong-Gyu Kim, Yongin-si (KR); Hai-Jung In, Seoul (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 15/893,115

(22) Filed: Feb. 9, 2018

(65) Prior Publication Data

US 2018/0166012 A1 Jun. 14, 2018

Related U.S. Application Data

(62) Division of application No. 14/994,632, filed on Jan. 13, 2016, now abandoned.

(30) Foreign Application Priority Data

Jun. 16, 2015 (KR) ..... 10-2015-0084775

(51) Int. Cl.

| | |
|---|---|
| ***G09G 3/3241*** | (2016.01) |
| ***G09G 3/3291*** | (2016.01) |
| ***G09G 3/3233*** | (2016.01) |

(52) U.S. Cl.
CPC ... *G09G 3/3233* (2013.01); *G09G 2300/0819* (2013.01); *G09G 2300/0861* (2013.01);
(Continued)

(58) Field of Classification Search
CPC ..... G09G 3/3233; G09G 2300/0819; G09G 2320/0242; G09G 2330/028;
(Continued)

(56) References Cited

U.S. PATENT DOCUMENTS 7,471,268 B2 * 12/2008 Shimoda ..... G09G 3/3283 345/76
8,659,511 B2 * 2/2014 Ryu ..... G09G 3/3233 345/76
(Continued)

FOREIGN PATENT DOCUMENTS

KR 1020070016458 A 2/2007
KR 1020120028426 A 3/2012
(Continued)

*Primary Examiner* — Kwang-Su Yang
(74) *Attorney, Agent, or Firm* — Cantor Colburn LLP

(57) ABSTRACT

A display device includes a display panel including a first pixel, a second pixel, and a third pixel, a scan driver configure to provide a scan signal to the first through the third pixels, a data driver which provides a data signal to the first through the third pixels, a reference voltage generator which provides a first reference voltage that compensates a degradation of a first driving transistor, a second reference voltage that compensates a degradation of a second driving transistor, and a third reference voltage that compensates a degradation of a third driving transistor, and a timing controller which generates a control signal that controls the scan driver, the data driver, and the reference voltage generator.

10 Claims, 9 Drawing Sheets

(52) U.S. Cl.
CPC ..... *G09G 2320/029* (2013.01); *G09G 2320/0242* (2013.01); *G09G 2320/043* (2013.01); *G09G 2330/028* (2013.01)

(58) Field of Classification Search
CPC ..... G09G 2320/029; G09G 2320/043; G09G 2300/0861
See application file for complete search history.

(56) References Cited

U.S. PATENT DOCUMENTS

| | | | | |
|---|---|---|---|---|
| 2005/0104821 | A1* | 5/2005 | Doe | G09G 3/3216 345/82 |
| 2006/0061292 | A1 | 3/2006 | Koh et al. | |
| 2007/0097041 | A1 | 5/2007 | Park et al. | |
| 2009/0066617 | A1* | 3/2009 | Chang | G09G 3/3233 345/83 |
| 2009/0141051 | A1* | 6/2009 | Sun | G09G 3/3275 345/690 |
| 2009/0174628 | A1* | 7/2009 | Wang | G09G 3/3225 345/76 |
| 2011/0069098 | A1* | 3/2011 | Lee | G09G 3/3225 345/691 |
| 2011/0157249 | A1* | 6/2011 | Park | G09G 3/3275 345/690 |
| 2015/0130780 | A1 | 5/2015 | Kwon et al. | |
| 2016/0189635 | A1 | 6/2016 | Lee et al. | |
| 2016/0314741 | A1* | 10/2016 | Yin | G09G 3/3258 |

FOREIGN PATENT DOCUMENTS

| | | | |
|---|---|---|---|
| KR | 1020140053606 | A | 5/2014 |
| KR | 1020140080622 | A | 7/2014 |

* cited by examiner

DISPLAY DEVICE HAVING COMPENSATION FOR DEGRADATION OF DRIVING TRANSISTORS AND ELECTRONIC DEVICE HAVING THE SAME

This application is a divisional of U.S. patent application Ser. No. 14/994,632, filed on Jan. 13, 2016, which claims priority to Korean Patent Application No. 10-2015-0084775, filed on Jun. 16, 2015, and all the benefits accruing therefrom under 35 U.S.C. § 119, the content of which in its entirety is herein incorporated by reference.

BACKGROUND

1. Field

Exemplary embodiments relate generally to a display device. More particularly, embodiments of the invention relate to a display device and an electronic device having the same.

2. Description of the Related Art

A flat panel display ("FPD") device is widely used as a display device of electronic devices because the FPD device is relatively lightweight and thin compared to a cathode-ray tube ("CRT") display device. Examples of the FPD device are a liquid crystal display ("LCD") device, a field emission display ("FED") device, a plasma display panel ("PDP") device, and an organic light emitting display ("OLED") device. The OLED device has been spotlighted as next-generation display devices because the OLED device has various advantages such as a wide viewing angle, a rapid response speed, a thin thickness, low power consumption, etc.

Generally, the organic light emitting display device includes a pixel circuit, a driving transistor and an organic light emitting diode. The organic light emitting diode emits light based on a driving current. A brightness of the organic light emitting diode may be changed by a property of a threshold voltage and a degradation degree of the organic light emitting diode.

SUMMARY

A white balance of a display panel may be distorted because degradation speeds of driving transistors coupled to an organic light emitting display ("OLED") that emits red color light, an OLED that emits green color light, and an OLED that emits blue color light are different from one another.

Exemplary embodiments provide a display device capable of compensating degradations of driving transistors of which degradation speeds are different from one another.

Exemplary embodiments provide an electronic device capable of compensating degradations of driving transistors of which degradation speeds are different from one another.

According to exemplary embodiments, a display device may include a display panel including a first pixel, a second pixel, and a third pixel, a scan driver which provides a scan signal to the first pixel, the second pixel, and the third pixel through scan lines coupled to the first pixel, the second pixel, and the third pixel, a data driver which provides a data signal to the first pixel, the second pixel, and the third pixel through data lines coupled to the first pixel, the second pixel, and the third pixel, a reference voltage generator which provides a first reference voltage that compensates a degradation of a first driving transistor included in the first pixel, a second reference voltage that compensates a degradation of a second driving transistor included in the second pixel, and a third reference voltage that compensates a degradation of a third driving transistor included in the third pixel, and a timing controller which generates a control signal that controls the scan driver, the data driver, and the reference voltage generator.

In exemplary embodiments, the reference voltage generator may include a first reference voltage generator which provides the first reference voltage through the data line coupled to the first pixel, a second reference voltage generator which provides the second reference voltage through the data line coupled to the second pixel, and a third reference voltage generator which provides the third reference voltage through the data line coupled to the third pixel.

In exemplary embodiments, the first reference voltage generator may control a voltage level of the first reference voltage.

In exemplary embodiments, where the second reference voltage generator may control a voltage level of the second reference voltage.

In exemplary embodiments, the third reference voltage generator may control a voltage level of the third reference voltage.

In exemplary embodiments, the first reference voltage generator may control an applied time period of the first reference voltage.

In exemplary embodiments, the second reference voltage generator may control an applied time period of the second reference voltage.

In exemplary embodiments, the third reference voltage generator may control an applied time period of the third reference voltage.

In exemplary embodiments, the display device may further include a compensating current calculator which calculates compensating currents of every grayscales of the first pixel, the second pixel, and the third pixel.

In exemplary embodiments, the reference voltage generator generates the first reference voltage provided to the first pixel, the second reference voltage provided to the second pixel, and the third reference voltage provided to the third pixel based on the compensating currents.

According to exemplary embodiments, an electronic device may include a display device and a processor that controls the display device. The display device may include a display device including a first pixel, a second pixel, and a third pixel, a scan driver which provides a scan signal to the first pixel, the second pixel, and the third pixel through scan lines coupled to the first pixel, the second pixel and the third pixel, a data driver which provides a data signal to the first pixel, the second pixel, and the third pixel through data lines coupled to the first pixel, the second pixel, and the third pixel, a reference voltage generator which provides a first reference voltage that compensates a degradation of a first driving transistor included in the first pixel, a second reference voltage that compensates a degradation of a second driving transistor included in the second pixel, and a third reference voltage that compensates a degradation of a third driving transistor included in the third pixel, and a timing controller which generates a control signal that controls the scan driver, the data driver, and the reference voltage generator.

In exemplary embodiments, the reference voltage generator may include a first reference voltage generator which provides the first reference voltage through the data line coupled to the first pixel, a second reference voltage generator which provides the second reference voltage through the data line coupled to the second pixel, and a third reference voltage generator which provides the third reference voltage through the data line coupled to the third pixel.

In exemplary embodiments, the first reference voltage generator may control a voltage level of the first reference voltage.

In exemplary embodiments, the second reference voltage generator may control a voltage level of the second reference voltage.

In exemplary embodiments, the third reference voltage generator may control a voltage level of the third reference voltage.

In exemplary embodiments, the first reference voltage generator may control an applied time period of the first reference voltage.

In exemplary embodiments, the second reference voltage generator may control an applied time period of the second reference voltage.

In exemplary embodiments, the third reference voltage generator may control an applied time period of the third reference voltage.

In exemplary embodiments, the electronic device may further include a compensating current calculator which calculates compensating currents of every grayscales of the first pixel, the second pixel, and the third pixel.

In exemplary embodiments, the reference voltage generator may generate the first reference voltage provided to the first pixel, the second reference voltage provided to the second pixel, the third reference voltage provided to the third pixel based ton the compensating currents.

Therefore, a display device according to exemplary embodiments may compensate a degradation of driving transistors of which degradation speeds are different from one another by providing reference voltages that are different from one another to pixels. Thus, a distortion of white balance of a display panel occurred by different degradation speeds of the driving transistors may be prevented.

BRIEF DESCRIPTION OF THE DRAWINGS

Illustrative, non-limiting exemplary embodiments will be more clearly understood from the following detailed description taken in conjunction with the accompanying drawings.

FIG. 8 is implemented as a smart phone.

DETAILED DESCRIPTION

Figure 1:
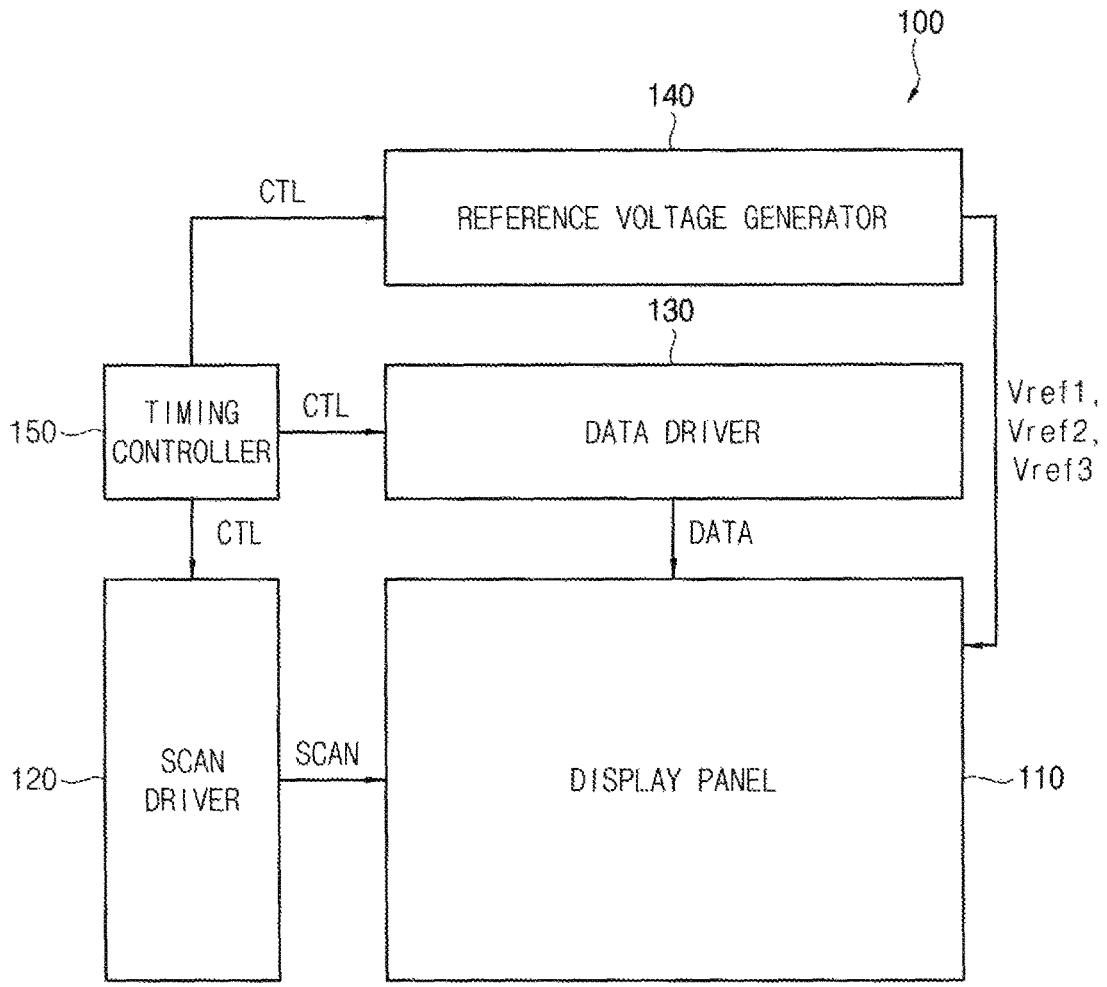
FIG. 1 is a block diagram illustrating a display device according to exemplary embodiments.

Hereinafter, the invention will be explained in detail with reference to the accompanying drawings. This invention may, however, be embodied in many different forms, and should not be construed as limited to the embodiments set forth herein. Rather, these embodiments are provided so that this invention will be thorough and complete, and will fully convey the scope of the invention to those skilled in the art. Like reference numerals refer to like elements throughout.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Figure 2:
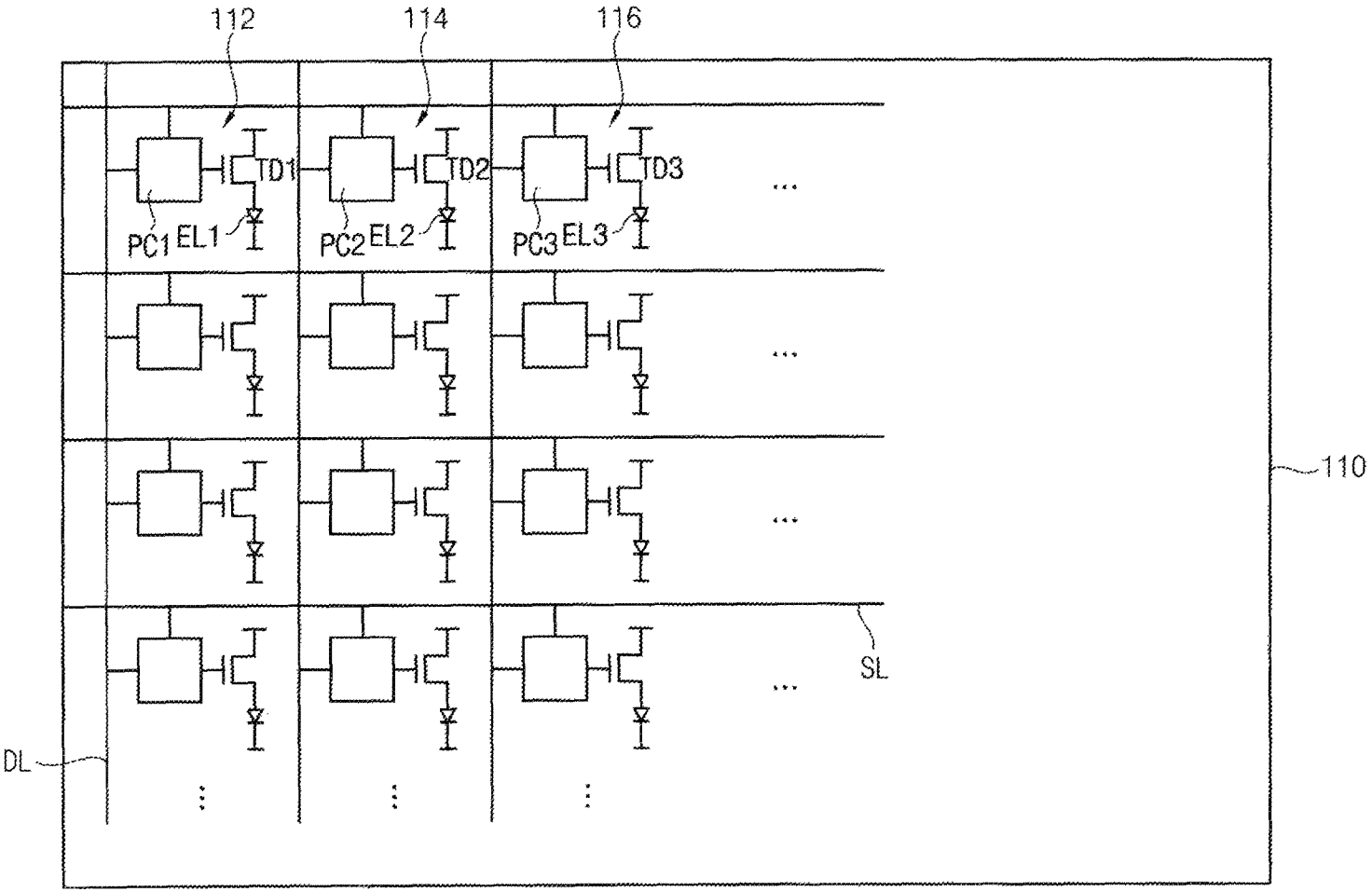
FIG. 2 is a diagram illustrating a display panel included in the display device of FIG. 1.
Figure 3A:
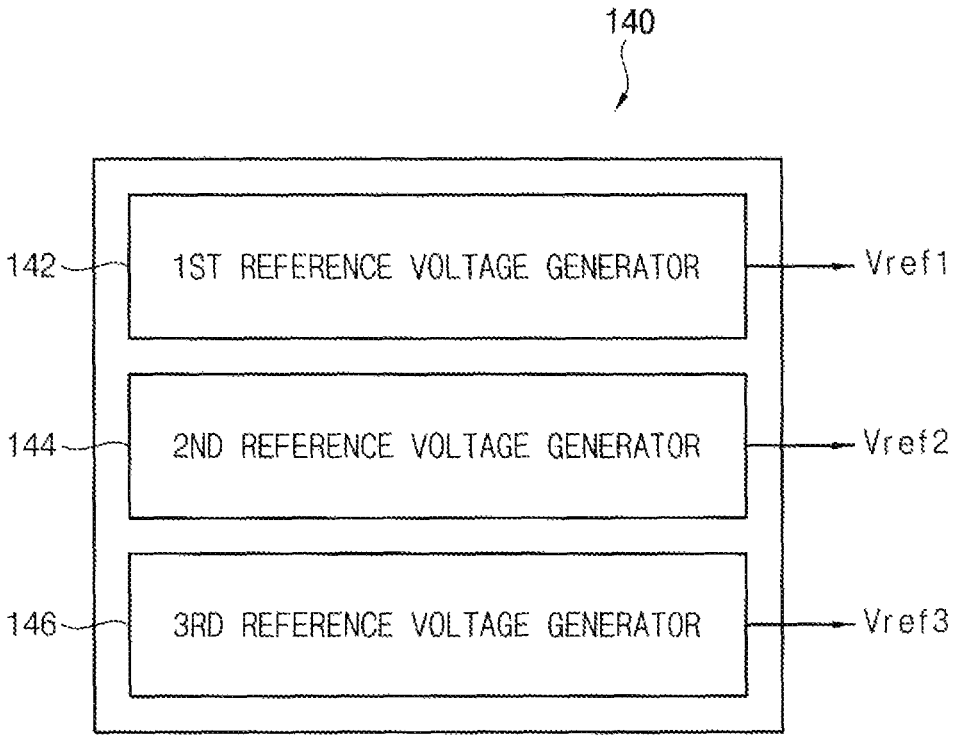
FIG. 3A is a block diagram illustrating exemplary embodiments of a reference voltage generator included in the display device of FIG. 1.
Figure 3B:
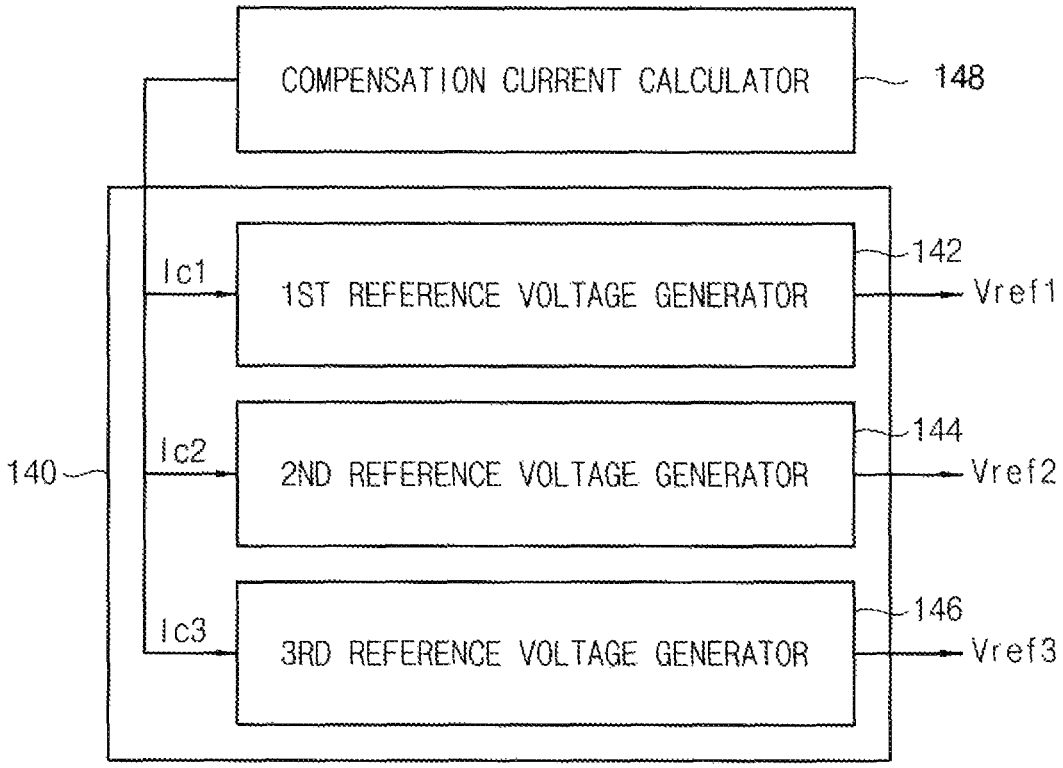
FIG. 3B is a block diagram illustrating another exemplary embodiments of a reference voltage generator included in the display device of FIG. 1.

FIG. 1 is a block diagram illustrating a display device according to exemplary embodiments. FIG. 2 is a diagram illustrating a display panel included in the display device of FIG. 1. FIG. 3A is a block diagram illustrating exemplary embodiments of a reference voltage generator included in the display device of FIG. 1. FIG. 3B is a block diagram illustrating another exemplary embodiments of a reference voltage generator included in the display device of FIG. 1.

Referring to FIGS. 1 and 2, the display device 100 may include a display panel 110, a scan driver 120, a data driver 130, a reference voltage generator 140, and a timing controller 150.

The display panel 110 may include a first pixel 112, a second pixel 114, and a third pixel 116. A plurality of data lines DL and a plurality of scan lines SL may be disposed on the display panel 110. The first pixel 112, the second pixel 114, and the third pixel 116 may be provided in intersection regions of the data lines DL and the scan lines SL. The first pixel 112 may include a first pixel circuit PC1, a first driving transistor TD1, and a first organic light emitting diode EL1. In this case, the first driving transistor TD1 may control a driving current flowing through the first organic light emitting diode EL1 based on the data signal DATA, where the data signal DATA is provided to the first driving transistor TD1 via the data line DL in response to the scan signal SCAN, and where the scan signal SCAN is provided via the scan line SL. Here, the driving current flowing through the first organic light emitting diode EL1 may be changed by a threshold voltage of the first driving transistor TD1 and a degradation degree of the first driving transistor TD1. The second pixel 114 may include a second pixel circuit PC2, a second driving transistor TD2, and a second organic light emitting diode EL2. In this case, the second driving transistor TD2 may control a driving current flowing through the second organic light emitting diode EL2 based on the data signal DATA, where the data signal DATA is provided to the second driving transistor TD2 via the data line DL in response to the scan signal SCAN, and where the scan signal SCAN is provided via the scan line SL. Here, the driving current flowing through the second organic light emitting diode EL2 may be changed by a threshold voltage of the second driving transistor TD2 and a degradation degree of the second driving transistor TD2. The third pixel 116 may include a third pixel circuit PC3, a third driving transistor TD3, and a third organic light emitting diode EL3. In this case, the third driving transistor TD3 may control a driving current flowing through the third organic light emitting diode EL3 based on the data signal DATA, where the data signal DATA is provided to the third driving transistor TD3 via the data line DL in response to the scan signal SCAN, where the scan signal SCAN is provided via the scan line SL. Here, the driving current flowing through the third organic light emitting diode EL3 may be changed by a threshold voltage of the third driving transistor TD3 and a degradation degree of the third driving transistor TD3. In an exemplary embodiment, the first organic light emitting diode EL1 may emit red color light, the second organic light emitting diode EL2 may emit green color light, and the third organic light emitting diode EL3 may emit blue color light, for example. Degradation speeds of the first driving transistor TD1, the second driving transistor TD2, and the third driving transistor TD3 may be different from one another according to data voltages provided to each of the first pixel 112, the second pixel 114, and the third pixel 116 and properties of the first organic light emitting diode EL1 included in the first pixel 112, the second organic light emitting diode EL2 included in the second pixel 114, and the third organic light emitting diode EL3 included in the third pixel 116.

The scan driver 120 may provide the scan signal SCAN to the first pixel 112, the second pixel 114, and the third pixel 116 through the plurality of scan lines SL. The data driver 130 may provide the data signal DATA to the first pixel 112, the second pixel 114, and the third pixel 116 through the plurality of data line DL in response to the scan signal SCAN.

The reference voltage generator 140 may generate a first reference voltage Vref1 that compensates a degradation of the first driving transistor TD1 included in the first pixel 112, a second reference voltage Vref2 that compensates a degradation of the second driving transistor TD2 included in the second pixel 114, and a third reference voltage Vref3 that compensates a degradation of the third driving transistor TD3. The first reference voltage Vref1 may be a voltage provided to the first pixel 112 to compensate the threshold voltage and the degradation of the first driving transistor TD1. The second reference voltage Vref2 may be a voltage provided to the second pixel 114 to compensate the threshold voltage and the degradation of the second driving transistor TD2. The third reference voltage Vref3 may be a voltage provided to the third pixel 116 to compensate the threshold voltage and the degradation of the third driving transistor TD3. The degradation degrees of the first driving transistor TD1, the second driving transistor TD2, and the third driving transistor TD3 may be different from one another by the data signal DATA provided to each of the first driving transistor TD1, the second driving transistor TD2, and the third driving transistor TD3.

The reference voltage generator 140 may include the first reference voltage generator 142, the second reference voltage generator 144, and the third reference voltage generator 146 as described in FIG. 3A. The first reference generator 142 may generate the first reference voltage Vref1 based on the degradation degree of the first driving transistor TD1. The second reference generator 144 may generate the second reference voltage Vref2 based on the degradation degree of the second driving transistor TD2. The third reference generator 146 may generate the third reference voltage Vref3 based on the degradation degree of the third driving transistor TD3. In exemplary embodiments, the first reference voltage Vref1, the second reference voltage Vref2, and the third reference voltage Vref3 may have different voltage level. In other exemplary embodiments, the first reference voltage Vref1, the second reference voltage Vref2, and the third reference voltage Vref3 may have the same voltage level and different applied time periods. Here, the first reference voltage generator 142 may control the applied time period of the first reference voltage Vref1 based on the degradation degree of the first driving transistor TD1, the second reference generator 144 may control the applied time period of the second reference voltage Vref2 based on the degradation degree of the second driving transistor TD2, and the third reference generator 146 may control the applied time period of the third reference voltage Vref3 based on the degradation degrees of the third driving transistor TD3. In other exemplary embodiments, the first reference voltage Vref1, the second reference voltage Vref2, and the third reference voltage Vref3 may have the same voltage level and the same applied time periods. Here, the first pixel circuit PC1 of the first pixel 112 may control the applied time period of the first reference voltage Vref1 based on the degradation degree of the first driving transistor TD1, the second pixel circuit PC2 of the second pixel 114 may control the applied time period of the second reference voltage Vref2 based on the degradation degree of the second driving transistor TD2, and the third pixel circuit PC3 of the pixel 116 may control the applied time period of the third reference voltage Vref3 based on the degradation degrees of the third driving transistor TD3.

The first reference voltage generator 142 may provide the first reference voltage Vref1 to the first pixel 112 through the data line DL coupled to the first pixel 112. In exemplary embodiments, the first reference voltage generator 142 may control the voltage level of the first reference voltage Vref1. In an exemplary embodiment, when the degradation of the third driving transistor TD3 is more proceeded than the degradation of the first driving transistor TD1, the first reference voltage generator 142 may generate the first reference voltage Vref1 having the voltage level higher than the voltage level of the third reference voltage Vref3, for example. In other exemplary embodiments, the first reference voltage generator 142 may control the applied time period of the first reference voltage Vref1. In an exemplary embodiment, when the degradation of the third driving transistor TD3 is more proceeded than the degradation of the first driving transistor TD1, the first reference voltage generator 142 may apply the first reference voltage Vref1 longer than the third reference voltage Vref3 having the same voltage level as that of the first reference voltage Vref1. The second reference voltage generator 144 may provide the second reference voltage Vrf2 to the second pixel 114 through the data line DL coupled to the second pixel 114. In exemplary embodiments, the second reference voltage generator 144 may control the voltage level of the second reference voltage Vref2. In other exemplary embodiments, the second reference voltage generator 144 may control the applied time period of the second reference voltage Vref2. The third reference voltage generator 146 may provide the third reference voltage Vrf3 to the third pixel 116 through the data line DL coupled to the third pixel 116. In exemplary embodiments, the third reference voltage generator 146 may control the voltage level of the third reference voltage Vref3. In other exemplary embodiments, the third reference voltage generator 146 may control the applied time period of the third reference voltage Vref3.

The reference voltage generator 140 may include the first reference voltage generator 142, the second reference voltage generator 144, the third reference voltage generator 146, and the compensating current calculator 148 as described in FIG. 3B. The compensating current calculator 148 may calculate compensating currents of every grayscales. In an exemplary embodiment, referring to FIGS. 1, 2 and 3B, the compensating current calculator 148 may sequentially display images having each of the grayscales, and sense driving currents of the first pixel 112, the second pixel 114, and the third pixel 116, for example. The compensating current calculator 148 may calculate a compensating current Ic1 of the first pixel 112 based on the driving current of the first pixel 112. The compensating current calculator 148 may calculate a compensating current Ic2 of the second pixel 114 based on the driving current of the second pixel 114. The compensating current calculator 148 may calculate a compensating current Ic3 of the third pixel 116 based on the driving current of the third pixel 116. The compensating current calculator 148 may store the first compensating current Ic1 of the first pixel 112, the second compensating current Ic2 of the second pixel 114, and the third compensating current Ic3 of the third pixel 116 in a memory device. The reference voltage generator 140 may generate the first reference voltage Vref1 based on the compensating current Ic1 of the first pixel 112 provided from the compensating current calculator 148, the second reference voltage Vref2 based on the compensating current Ic2 of the second pixel 114 provided from the compensating current calculator 148, and the third reference voltage Vref3 based on the compensating current Ic3 of the third pixel 116 provided from the compensating current calculator 148.

The timing controller 150 may generate control signals CTL that control the scan driver 120, the data driver 130, and the reference voltage generator 140.

As described above, the display device 100 of FIG. 1 may include the reference voltage generator 140 that compensates the threshold voltage and the degradation of the first driving transistor TD1 included in the first pixel 112, the second driving transistor TD2 included in the second pixel 114, and the third driving transistor TD3 included in the third pixel 116. The reference voltage generator 140 may generate the first reference voltage Vref1 that compensates the threshold voltage and the degradation of the first driving transistor TD1, the second reference voltage Vref2 that compensates the threshold voltage and the degradation of the second driving transistor TD2, the third reference voltage Vref3 that compensates the threshold voltage and the degradation of the third driving transistor TD3. The display device 100 may compensate each of the degradation of the first driving transistor TD1, the degradation of the second driving transistor TD2, and the degradation of the third driving transistor TD3 by providing the first reference voltage Vref1, the second reference voltage Vref2, and the third reference voltage Vref3 of which the voltage levels or the applied time periods are different from one another to the first pixel 112, the second pixel 114, and the third pixel 116, respectively.

Thus, an image quality of the display device 100 may be improved by preventing a distortion of the white balance.

Figure 4:
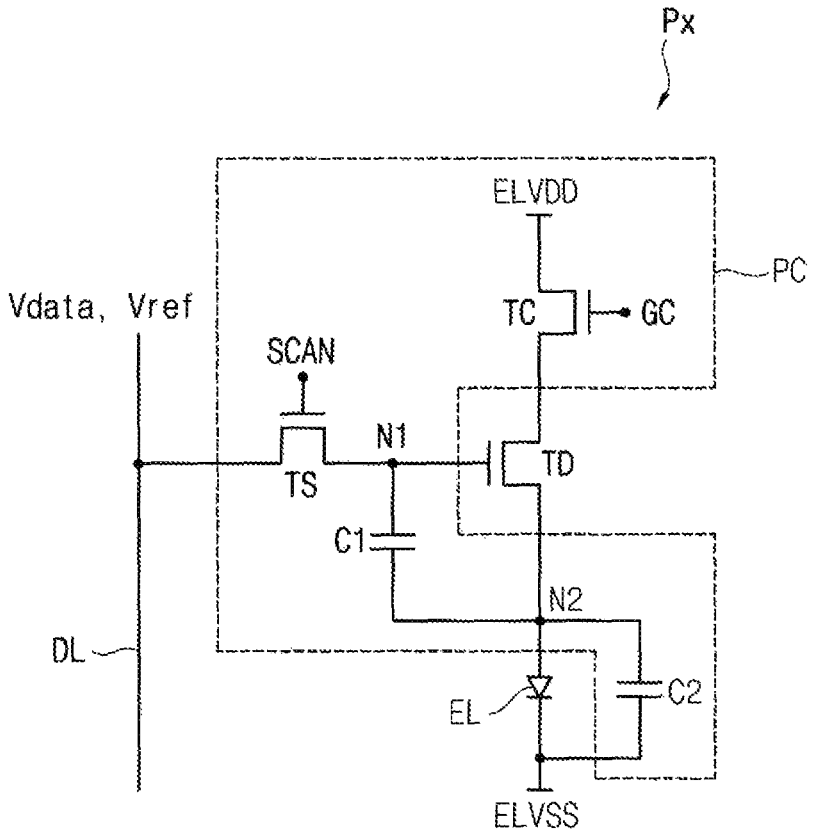
FIG. 4 is a circuit diagram illustrating exemplary embodiments of a pixel included in the display panel of FIG. 2.

FIG. 4 is a circuit diagram illustrating exemplary embodiments of a pixel included in the display panel of FIG. 2.

Referring to FIG. 4, a pixel Px may include a pixel circuit PC, a driving transistor TD, and an organic light emitting diode EL. The pixel Px of FIG. 4 may correspond to the first pixel 112, the second pixel 114, and the third pixel 116 of FIG. 2.

Referring to FIG. 4, the pixel circuit PC may include a scan transistor TS, an emission control transistor TC, a first storage capacitor C1, and a second storage capacitor C2. The scan transistor TS may be turned on or turned off in response to a scan signal SCAN provided from a scan driver. When the scan transistor TS turns on, a voltage may be provided to the first node N1 through a data line DL. The emission control transistor TC may be turned on or turned off in response to an emission control signal GC provided from the scan driver or an emission control driver, thereby applying the high power voltage ELVDD to an electrode of the driving transistor TD. When the emission control transistor TC turns on, the driving current from the driving transistor TD may flow through the organic light emitting diode EL. The first storage capacitor C1 may store a difference between the voltage of the first node N1 and the voltage of a second node N2. The second storage capacitor C2 may store a difference between the voltage of the second node N2 and a low power voltage ELVSS.

The pixel Px of FIG. 4 may be operated in an initializing period, a threshold voltage compensating period, a data writing period, and an emission period. An anode electrode (that is, the second node N2) of the organic light emitting diode EL is initialized during the initializing period. Further, a threshold voltage of the driving transistor may be stored in the first storage capacitor C1 during the initializing period. A reference voltage Vref may be provided through the data line DL during the threshold voltage compensating period. Here, the difference of the reference voltage Vref and the threshold voltage may be stored in the second storage capacitor C2. A data voltage Vdata corresponding to the data signal provided from a data driver through the data line DL may be provided to the pixel during the data writing period. Here, the data voltage Vdata may be stored in the first storage capacitor C1. The driving transistor Td may generate the driving current based on the data voltage Vdata and the reference voltage Vref during the emission period. Here, the threshold voltage of the driving transistor TD may generate the driving voltage that is not related to the threshold voltage of the driving transistor TD because the threshold voltage of the driving transistor TD is cancelled with the threshold voltage stored in the second storage capacitor C2. Thus, the driving current of the driving transistor TD may be determined based on the data voltage Vdata and the reference voltage Vref.

Figure 5A:
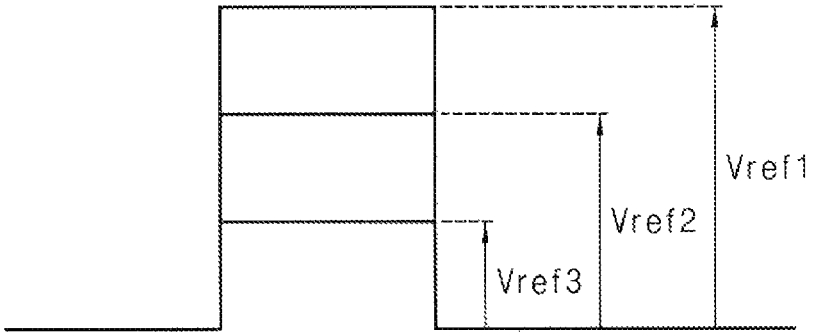
FIGS. 5A and 5B are diagrams illustrating for describing exemplary embodiments of an operation of a reference voltage generator included in the display device of FIG. 1.
Figure 5B:
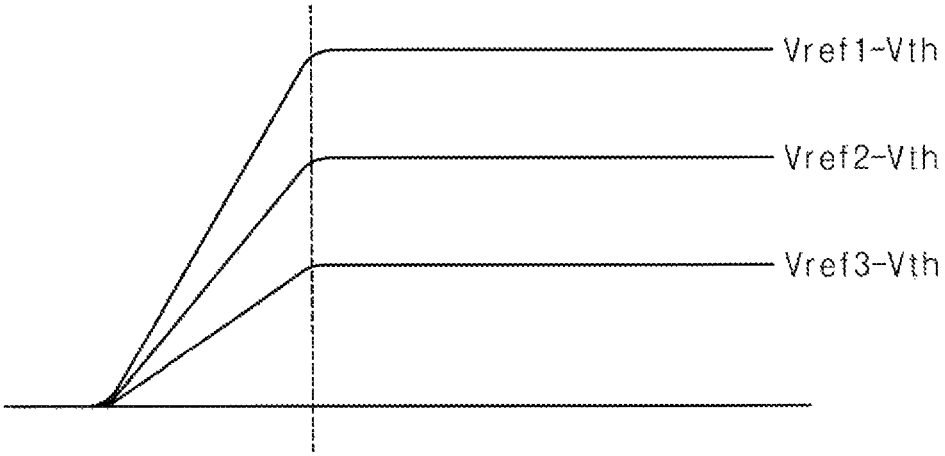

FIGS. 5A and 5B are diagrams illustrating for describing exemplary embodiments of an operation of a reference voltage generator included in the display device of FIG. 1.

Referring to FIG. 5A, a reference voltage generator may provide a first reference voltage Vref1, a second reference voltage Vref2, and a third reference voltage Vref3 having different voltage levels from one another through the data line DL during a threshold voltage compensating period. Specifically, the reference voltage generator 140 may include a first reference voltage generator 142 (refer to FIGS. 3A and 3B) that generate the first reference voltage Vref1, a second reference voltage generator 144 (refer to FIGS. 3A and 3B) that generate the second reference voltage Vref2, and a third reference voltage generator 146 (refer to FIGS. 3A and 3B) that generate the third reference voltage Vref3. The first reference voltage generator 142 may control the voltage level of the first reference voltage Vref1 based on a degradation degree of the first driving transistor TD1. The second reference voltage generator 144 may control the voltage level of the second reference voltage Vref2 based on a degradation degree of the second driving transistor TD2. The third reference voltage generator 146 may control the voltage level of the third reference voltage Vref3 based on a degradation degree of the third driving transistor TD3. Here, the voltage level of the first reference voltage Vref1, the voltage level of the second reference voltage Vref2, and the voltage level of the third reference voltage Vref3 may be different from one another because the degradation degrees of the first driving transistor TD1, the second driving transistor TD2, and the third driving transistor TD3 are different from one another.

The first reference voltage Vref1, the second reference voltage Vref2, and the third reference voltage Vref3 may be provided to a first pixel 112, a second pixel 114, a third pixel 116 through the data line DL during a threshold voltage compensating period. The first reference voltage Vref1, the second reference voltage Vref2, and the third reference voltage Vref3 may be provided to the first node N1 of the pixel circuit PC through the scan transistor TS that turns on in response to the scan signal SCAN during the threshold voltage compensating period. The difference of the reference voltage and the threshold voltage (Vref-Vth) may be stored in the second storage capacitor C2 as described in FIG. 5B. Here, the voltages stored in the second storage capacitor C2 of the first pixel 112, in the second storage capacitor C2 of the second pixel 114, and in the second storage capacitor C2 of the third pixel 116 may be different from one another because the voltage levels of the first reference voltage Vref1, the second reference voltage Vref2, and the third reference voltage Vref3 are different from one another. Thus, the first driving transistor TD1, the second driving transistor TD2, and the third driving transistor TD3 may generate the driving currents that compensate each of the degradations.

Figure 6A:
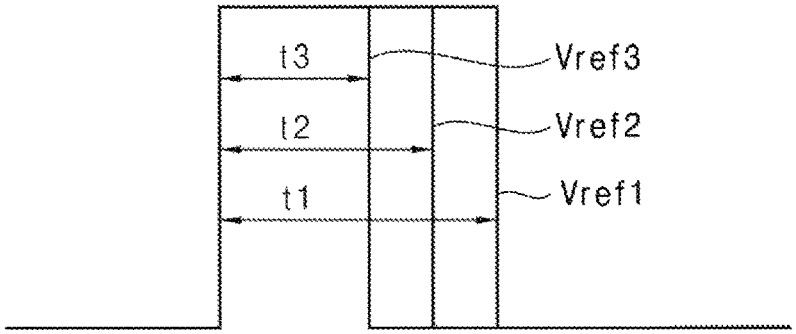
FIGS. 6A and 6B are diagrams illustrating for describing another exemplary embodiments of an operation of a reference voltage generator included in the display device of FIG. 1.
Figure 6B:
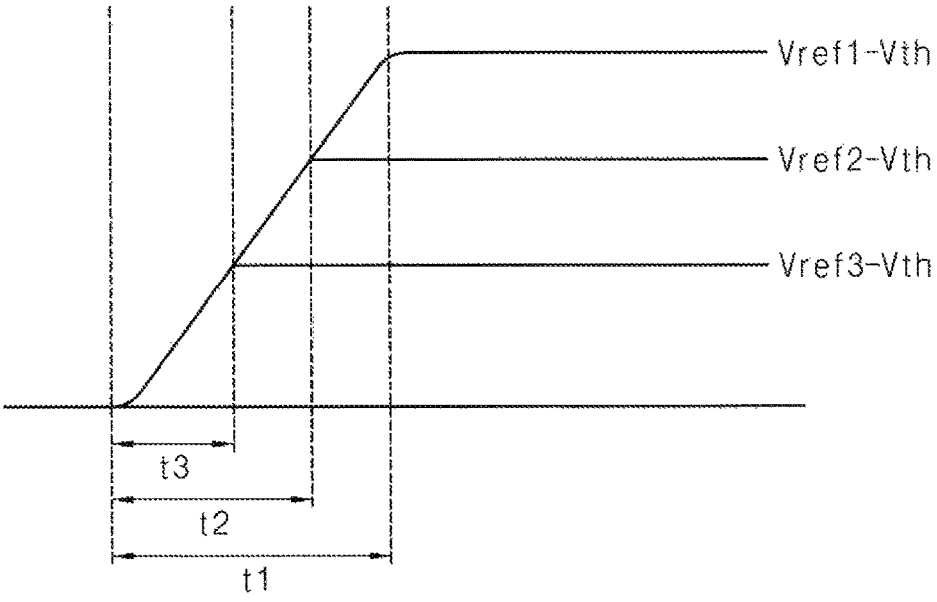

FIGS. 6A and 6B are diagrams illustrating for describing another exemplary embodiments of an operation of a reference voltage generator included in the display device of FIG. 1.

Referring to FIG. 6A, a reference voltage generator may control an applied time periods of a first reference voltage Vref1, a second reference voltage Vref2, and a third reference voltage Vref3 provided through the data line DL during a threshold voltage compensating period. Specifically, the reference voltage generator may include a first reference voltage generator 142 that generate the first reference voltage Vref1, a second reference voltage generator 144 that generate the second reference voltage Vref2, and a third reference voltage generator 146 that generate the third reference voltage Vref3. Here, voltage levels of the first reference voltage Vref1, the second reference voltage Vref2, and the third reference voltage Vref3 are the same. The first reference voltage generator 142 may control the applied time period t1 of the first reference voltage Vref1 based on a degradation degree of the first driving transistor TD1. The second reference voltage generator 144 may control the applied time period t2 of the second reference voltage Vref2 based on a degradation degree of the second driving transistor TD2. The third reference voltage generator 146 may control the applied time period t3 of the third reference voltage Vref3 based on a degradation degree of the third driving transistor TD3. Here, each of the first reference voltage generator 142, the second reference voltage generator 144, and the third reference voltage generator 146 may differently control the applied time period t1 of the first reference voltage Vref1, the applied time period t2 of the second reference voltage Vref2, and the applied time period t3 of the third reference voltage Vref3 because the degradation degrees of the first driving transistor TD1, the second driving transistor TD2, and the third driving transistor TD3 are different from one another.

The first reference voltage Vref1, the second reference voltage Vref2, and the third reference voltage Vref3 may be provided to a first pixel 112, a second pixel 114, a third pixel 116 through the data line DL during a threshold voltage compensating period. The first reference voltage Vref1, the second reference voltage Vref2, and the third reference voltage Vref3 may be provided to the first node N1 of the pixel circuit PC through the scan transistor TS that turns on in response to the scan signal during the threshold voltage compensating period. The difference of the reference voltage and the threshold voltage (Vref-Vth) may be stored in the second storage capacitor C2 as described in FIG. 6B. Here, the voltages stored in the second storage capacitor C2 of the first pixel 112, in the second storage capacitor C2 of the second pixel 114, and in the second storage capacitor C2 of the third pixel 116 may be different from one another because the applied time period t1 of the first reference voltage Vref1, the applied time period t2 of the second reference voltage Vref2, and the applied time period t3 of the third reference voltage Vref3 are different from one another. Thus, the first driving transistor TD1, the second driving transistor TD2, and the third driving transistor TD3 may generate the driving currents that compensate each of the degradations.

Figure 7A:
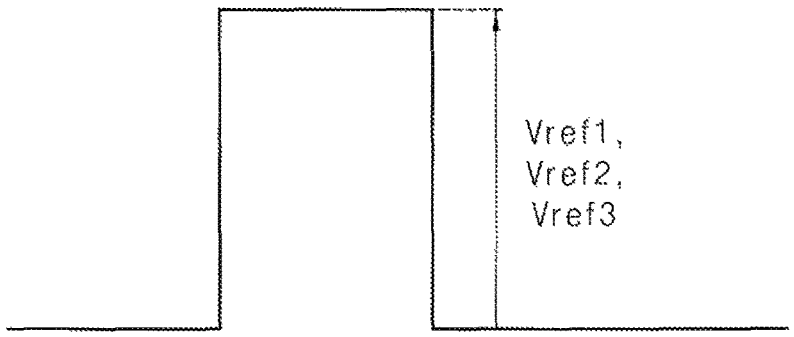
FIGS. 7A and 7B are diagrams illustrating for describing the other exemplary embodiments of an operation of a reference voltage generator included in the display device of FIG. 1.
Figure 7B:
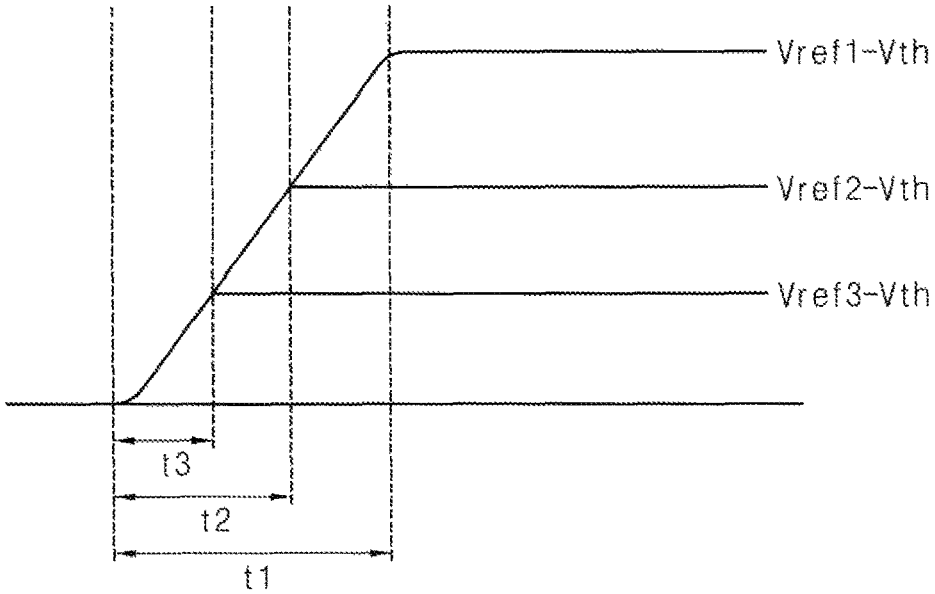

FIGS. 7A and 7B are diagrams illustrating for describing the other exemplary embodiments of an operation of a reference voltage generator included in the display device of FIG. 1.

Referring to FIG. 7A, a reference voltage generator may provide a first reference voltage Vref1, a second reference voltage Vref2, and a third reference voltage Vref3 through the data line DL during a threshold voltage compensating period. Specifically, the reference voltage generator may include a first reference voltage generator 142 that generate the first reference voltage Vref1, a second reference voltage generator 144 that generate the second reference voltage Vref2, and a third reference voltage generator 146 that generate the third reference voltage Vref3. Here, each of the first reference voltage Vref1, the second reference voltage Vref2, and the third reference voltage Vref3 may have the same voltage level and the same applied time periods.

The first reference voltage Vref1, the second reference voltage Vref2, and the third reference voltage Vref3 may be provided to a first pixel 112, a second pixel 114, a third pixel 116 through the data line DL during a threshold voltage compensating period. The first reference voltage Vref1, the second reference voltage Vref2, and the third reference voltage Vref3 may be provided to the first node N1 of the pixel circuit PC through the scan transistor TS that turns on in response to the scan signal during the threshold voltage compensating period. The difference of the reference voltage and the threshold voltage (Vref-Vth) may be stored in the second storage capacitor C2 as described in FIG. 7B. The applied time period t1 of the first reference voltage Vref1, the applied time period t2 of the second reference voltage Vref2, and the applied time period t3 of the third reference voltage Vref3 may be controlled by turning on or turning off an emission control transistor during the threshold voltage compensating period. Here, the voltages stored in the second storage capacitor C2 of the first pixel 112, in the second storage capacitor C2 of the second pixel 114, and in the second storage capacitor C2 of the third pixel 116 may be different from one another because the applied time period t1 of the first reference voltage Vref1, the applied time period t2 of the second reference voltage Vref2, and the applied time period t3 of the third reference voltage Vref3 are different from one another. Thus, the first driving transistor TD1, the second driving transistor TD2, and the third driving transistor TD3 may generate the driving currents that compensate each of the degradations.

Figure 8:
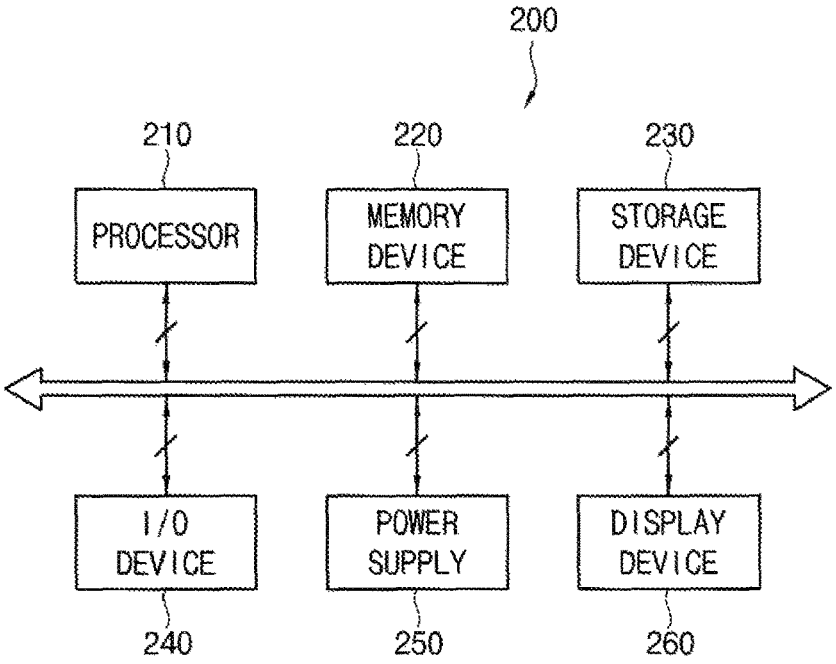
FIG. 8 is a block diagram illustrating an electronic device according to exemplary embodiments.
Figure 9:
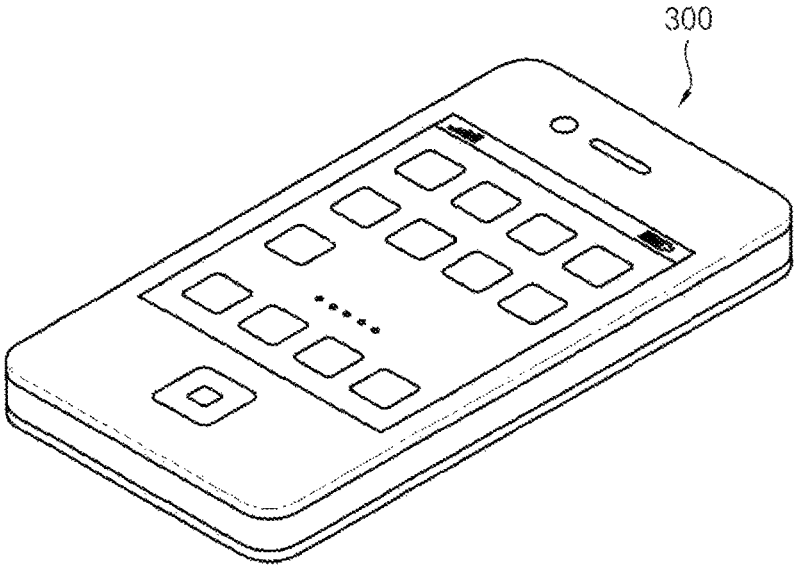
FIG. 9 is a diagram illustrating an exemplary embodiment in which the electronic device

FIG. 8 is a block diagram illustrating an electronic device according to exemplary embodiments and FIG. 9 is a diagram illustrating an exemplary embodiment in which the electronic device FIG. 8 is implemented as a smart phone.

Referring to FIGS. 8 and 9, an electronic device 200 may include a processor 210, a memory device 220, a storage device 230, an input/output ("I/O") device 240, a power supply 250, and a display device 260. Here, the display device 260 may correspond to the display device 100 of FIG. 1. In exemplary embodiments, the electronic device 200 may further include a plurality of ports for communicating a video card, a sound card, a memory card, a universal serial bus ("USB") device, other electronic device, etc. Although it is illustrated in FIG. 9 that the electronic device 300 is implemented as a smart-phone 300, a kind of the electronic device 200 is not limited thereto.

The processor 210 may perform various computing functions. In an exemplary embodiment, the processor 210 may be a micro processor, a central processing unit ("CPU"), etc., for example. In an exemplary embodiment, the processor 210 may be coupled to other components via an address bus, a control bus, a data bus, etc., for example. In an exemplary embodiment, the processor 210 may be coupled to an extended bus such as peripheral component interconnect ("PCI") bus, for example. The memory device 220 may store data for operations of the electronic device 200. In an exemplary embodiment, the memory device 220 may include at least one non-volatile memory device such as an erasable programmable read-only memory ("EPROM") device, an electrically erasable programmable read-only memory ("EEPROM") device, a flash memory device, a phase change random access memory ("PRAM") device, a resistance random access memory ("RRAM") device, a nano floating gate memory ("NFGM") device, a polymer random access memory ("PoRAM") device, a magnetic random access memory ("MRAM") device, a ferroelectric random access memory ("FRAM") device, etc, and/or at least one volatile memory device such as a dynamic random access memory ("DRAM") device, a static random access memory ("SRAM") device, a mobile DRAM device, etc., for example. In an exemplary embodiment, the storage device 230 may be a solid stage drive ("SSD") device, a hard disk drive ("HDD") device, a CD-ROM device, etc., for example.

In an exemplary embodiment, the I/O device 240 may be an input device such as a keyboard, a keypad, a touchpad, a touch-screen, a mouse, etc, and an output device such as a printer, a speaker, etc. In exemplary embodiments, the display device 260 may be included in the I/O device 240. The power supply 250 may provide a power for operations of the electronic device 200. In an exemplary embodiment, the display device 260 may communicate with other components via the buses or other communication links. As described above, the display device 210 may include a display panel, a scan driver, a data driver, a reference voltage generator, and a timing controller. The display panel may include a first pixel 112, a second pixel 114, and a third pixel 116. The first pixel 112 may include a first pixel circuit, a first driving transistor TD1, and a first organic light emitting diode. The first organic light emitting diode may emit light based on a driving current provided from the first driving transistor TD1. The second organic light emitting diode may emit light based on a driving current provided from the second driving transistor TD2. The third organic light emitting diode may emit light based on a driving current provided from the third driving transistor TD3. Here, the driving currents that flows through the first through the third organic light emitting diode according to threshold voltages and degradation degrees of the first through the third driving transistor TD3. Degradation speeds of the first driving transistor TD1, the second driving transistor TD2, and the third driving transistor TD3 may be different from one another according to properties of the first through the third organic light emitting diodes. The reference voltage generator may provide a first reference voltage that compensates a degradation of the first driving transistor TD1 included in the first pixel 112, a second reference voltage that compensates a degradation of the second driving transistor TD2 included in the second pixel 114, and a third reference voltage that compensates a degradation of the third driving transistor TD3 included in the third pixel 116. In exemplary embodiments, each of the first reference voltage Vref1, the second reference voltage Vref2, and the third reference voltage Vref3 may have different voltage level. In other exemplary embodiments, each of the first reference voltage Vref1, the second reference voltage Vref2, and the third reference voltage Vref3 may have the same voltage level and different applied time periods. In other exemplary embodiments, each of the first reference voltage Vref1, the second reference voltage Vref2, and the third reference voltage Vref3 may have the same voltage level and the same applied time periods. Here, the first pixel circuit PC1 of the first pixel 112 may controls the applied time period of the first reference voltage Vref1 based on the degree of the degradation of the first driving transistor TD1, the second pixel circuit PC2 of the second pixel 114 may controls the applied time period of the second reference voltage Vref2 based on the degree of the degradation of the second driving transistor TD2, and the third pixel circuit PC3 of the third pixel 116 may controls the applied time period of the third reference voltage Vref3 based on the degrees of the degradation of the third driving transistor TD3.

The display device 260 may further include a compensating current calculator that calculates a compensating current of every grayscale of the first pixel 112, the second pixel 114, and the third pixel 116. In an exemplary embodiment, the compensating current calculator may sense the driving current of every grayscale of the first pixel 112, the second pixel 114, and the third pixel 116 and calculate the compensating currents of the first pixel 112, the second pixel 114, and the third pixel 116. The reference voltage generator may generate the first reference voltage, the second reference voltage, and the third reference voltage based on the compensating current provided form the compensating current calculator.

As described above, the electronic device 200 of FIG. 8 may include the display device 260 that includes the reference voltage generator that generates the reference voltages provided to each of the first pixel 112, the second pixel 114, and the third pixel 116. The reference voltage generator of the display device 260 may respectively generate the first reference voltage that compensates the threshold voltage and the degradation of the first driving transistor TD1, the second reference voltage that compensates the threshold voltage and the degradation of the second driving transistor TD2, and the third reference voltage that compensates the threshold voltage and the degradation of the third driving transistor TD3. Thus, a quality of the display device 260 may be improved by preventing a distortion of the white balance occurred by difference of degradation speeds of the first driving transistor TD1, the second driving transistor TD2, and the third driving transistor TD3.

The invention may be applied to a display device and an electronic device having the display device. In an exemplary embodiment, the invention may be applied to a computer monitor, a laptop, a digital camera, a cellular phone, a smart phone, a smart pad, a television, a personal digital assistant ("PDA"), a portable multimedia player ("PMP"), a MP3 player, a navigation system, a game console, a video phone, etc., for example.

The foregoing is illustrative of exemplary embodiments and is not to be construed as limiting thereof. Although a few exemplary embodiments have been described, those skilled in the art will readily appreciate that many modifications are possible in the exemplary embodiments without materially departing from the novel teachings and advantages of the invention. Accordingly, all such modifications are intended to be included within the scope of the invention as defined in the claims. Therefore, it is to be understood that the foregoing is illustrative of various exemplary embodiments and is not to be construed as limited to the specific exemplary embodiments disclosed, and that modifications to the disclosed exemplary embodiments, as well as other exemplary embodiments, are intended to be included within the scope of the appended claims.

What is claimed is:

1. A display device comprising:

a display panel including a first pixel, a second pixel, and a third pixel;

a scan driver which provides a scan signal to the first pixel, the second pixel, and the third pixel through scan lines coupled to the first pixel, the second pixel, and the third pixel;

a data driver which provides a data signal to the first pixel, the second pixel, and the third pixel through data lines coupled to the first pixel, the second pixel, and the third pixel;

a reference voltage generator which provides a first reference voltage which compensates a degradation of a first driving transistor included in the first pixel, a second reference voltage which compensates a degradation of a second driving transistor included in the second pixel, and a third reference voltage which compensates a degradation of a third driving transistor included in the third pixel;

a timing controller which generates a control signal which controls the scan driver, the data driver, and the reference voltage generator; and a compensating current calculator which calculates compensating currents of every grayscales of the first pixel, the second pixel, and the third pixel and stores the compensating currents of the first pixel, the second pixel, and the third pixel in a memory device, wherein the reference voltage generator differently controls an applied time period length of the first reference voltage, an applied time period length of the second reference voltage, and an applied time period length of the third reference voltage, wherein the applied time period length of at least one of the first, second and third reference voltages is different from the applied time period length of at least one of the other first, second and third reference voltages, and wherein the first, second and third reference voltages are all applied beginning at a same time.

2. The display device of claim 1, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the first reference voltage generator controls an applied time period length of the first reference voltage.

3. The display device of claim 1, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the second reference voltage generator controls an applied time period length of the second reference voltage.

4. The display device of claim 1, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the third reference voltage generator controls an applied time period length of the third reference voltage.

5. The display device of claim 1, wherein the reference voltage generator generates the first reference voltage provided to the first pixel, the second reference voltage provided to the second pixel, and the third reference voltage provided to the third pixel based on the compensating currents.

6. An electronic device comprising a display device and a processor which controls the display device, wherein the display device includes:

a display panel including a first pixel, a second pixel, and a third pixel;

a scan driver which provides a scan signal to the first pixel, the second pixel, and the third pixel through scan lines coupled to the first pixel, the second pixel and the third pixel;

a data driver which provides a data signal to the first pixel, the second pixel, and the third pixel through data lines coupled to the first pixel, the second pixel, and the third pixel;

a reference voltage generator which provides a first reference voltage which compensates a degradation of a first driving transistor included in the first pixel, a second reference voltage which compensates a degradation of a second driving transistor included in the second pixel, and a third reference voltage which compensates a degradation of a third driving transistor included in the third pixel;

a timing controller which generates a control signal which controls the scan driver, the data driver, and the reference voltage generator; and a compensating current calculator which calculates compensating currents of every grayscales of the first pixel, the second pixel, and the third pixel and stores the compensating currents of the first pixel, the second pixel, and the third pixel in a memory device, wherein the reference voltage generator differently controls a length of an applied time period of the first reference voltage, a length of an applied time period of the second reference voltage, and a length of an applied time period of the third reference voltage, wherein the length of the applied time period of at least one of the first, second and third reference voltages is different from the length of the applied time period of at least one of the other first, second and third reference voltages, and wherein the first, second and third reference voltages are all applied beginning at a same time.

7. The electronic device of claim 6, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the first reference voltage generator controls a length of an applied time period of the first reference voltage.

8. The electronic device of claim 6, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the second reference voltage generator controls a length of an applied time period of the second reference voltage.

9. The electronic device of claim 6, wherein the reference voltage generator includes:

a first reference voltage generator which provides the first reference voltage through the data line coupled to the first pixel;

a second reference voltage generator which provides the second reference voltage through the data line coupled to the second pixel; and a third reference voltage generator which provides the third reference voltage through the data line coupled to the third pixel, and wherein the third reference voltage generator controls a length of an applied time period of the third reference voltage.

10. The electronic device of claim 6, wherein the reference voltage generator generates the first reference voltage provided to the first pixel, the second reference voltage provided to the second pixel, the third reference voltage provided to the third pixel based on the compensating currents.

* * * * *